US005090159A

United States Patent [19]

Patterson

[11] Patent Number: 5,090,159

[45] Date of Patent: Feb. 25, 1992

[54] MULTI-PURPOSE GRINDER

[76] Inventor: James Patterson, c/o P.O. Jamieson, 3723, Australia

[21] Appl. No.: 495,582

[22] Filed: Mar. 20, 1990

[30] Foreign Application Priority Data

Mar. 20, 1989 [AU] Australia ..... PJ3279

[51] Int. Cl.[5] ..... B24B 7/00

[52] U.S. Cl. ..... 51/34 R; 51/35; 51/47; 51/168; 51/241 R

[58] Field of Search ..... 51/34 R, 246, 288, 215, 51/218 T, 217 T, 34 C, 47, 68, 99, 168, 241 R, 35; 123/13.01, 13.03

[56] References Cited

U.S. PATENT DOCUMENTS

| | | | |
|---|---|---|---|
| 3,045,398 | 7/1962 | McEwan | 51/48 HE |
| 3,156,074 | 11/1964 | Baltz | 51/288 X |
| 3,656,264 | 4/1972 | Mackey | 51/288 |
| 3,755,971 | 9/1973 | Garcia | 51/285 X |
| 4,186,529 | 2/1980 | Huffman | 51/288 |
| 4,930,265 | 6/1990 | Belthle | 51/288 |
| 4,984,391 | 1/1991 | Sattler | 51/92 BS X |

*Primary Examiner*—M. Rachuba
*Attorney, Agent, or Firm*—Hoffman, Wasson & Gitler

[57] ABSTRACT

A multi-purpose grinding device for sharpening hardware ranging from scissors to saw blades. It comprises a powered grinding wheel which can be moved and oriented in a plurality of positions relative to the item to be sharpened which is held in a fixed location on a jig. The grinding wheel has lateral and vertical movement and can be tilted on its side.

7 Claims, 7 Drawing Sheets

II
7
19
15
5
4
8
9
13
18
17
6
12
2
20
9
10
31
3
II
1a
1
34
33
IV
IV

Fig. 10.
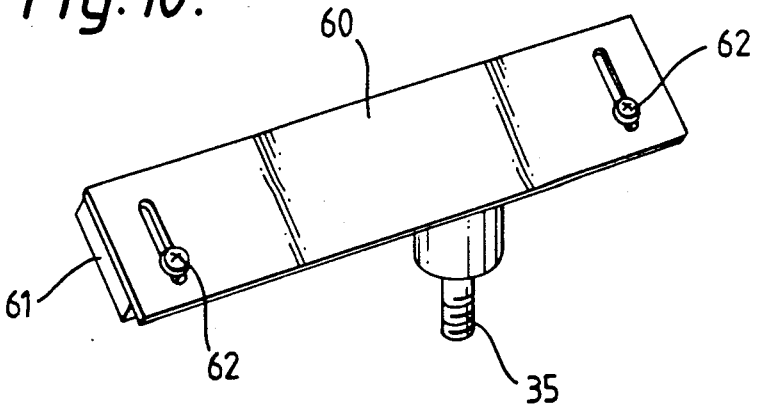
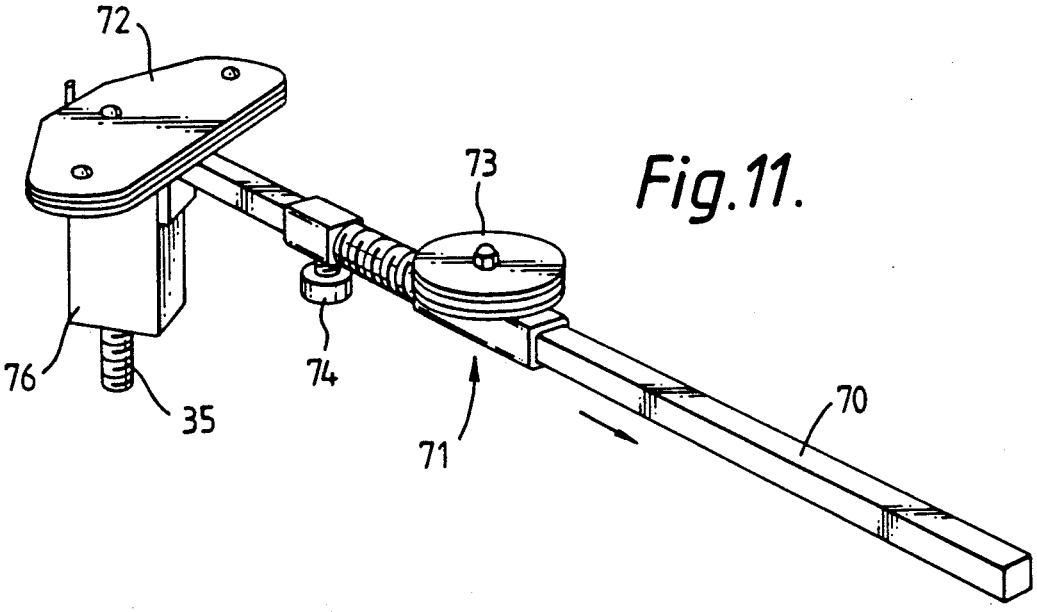
Fig. 11.
Fig. 12.
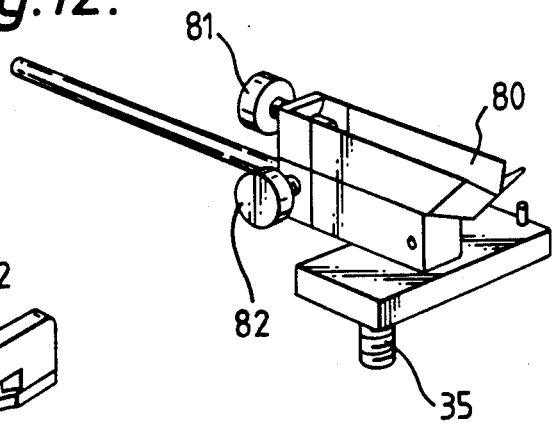
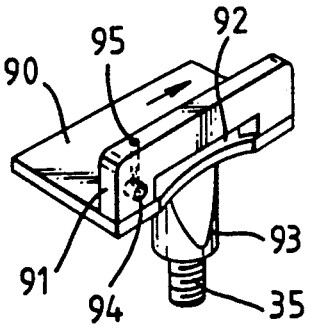
Fig. 13.

MULTI-PURPOSE GRINDER

This invention relates to equipment for grinding various hardware ranging from small domestic utensils through workshop tools to large industrial implements. The invention is particularly concerned with equipment for sharpening hardware such as scissors, chisels, twist drill bits, plane and circular saw blades, and the like, and will be described primarily in that context. However it will be readily appreciated by the skilled addressee that the invention is by no means limited to such preferred adaptations and has much wider ramifications as a multi-purpose workshop machine.

Small work tools are commonly sharpened with a simple bench-top grinder comprising a fixed grinding wheel coupled to the spindle of an electric motor. The process usually involves manually holding the tool against the rotating grinding wheel. This has the problem that one cannot sharpen the tool with a very great degree of accuracy with the result that the tool is either ground down more than it need be, or the cutting edge is given a non-uniform or wavy pattern.

Large work objects are commonly sharpened by machines specifically built for the particular object to be sharpened. Thus, for instance, circular saw blades are sharpened in a large grinding machine having a fixed grinding wheel and a movable support platform for the blade. In operation, the blade is secured to the platform and this is then manipulated with respect to the grinding wheel to effect the desired sharpening pattern on the blade. The machine is not suitable for sharpening the previously mentioned small work tools.

It is a primary object of the present invention to provide a device suitable for grinding a wide variety of hardware ranging from the very small objects to the very large industrial implements.

A further object of the invention is to provide a device which will accurately grind a piece of hardware within controllable and reproducible limits.

Accordingly, in its broadest aspect, the present invention provides a grinding device comprising a framework which supports a grinding wheel coupled to an electric motor, the improvement comprising an adjustment means which enables the grinding wheel to be located at a pre-determined position in space relative to the framework.

Preferably, the adjustment means comprises a grinding wheel tilting mechanism and a grinding wheel alignment mechanism. The tilting mechanism is such as to permit the grinding wheel to be moved to any one of an infinite number of planes, lying at an angle with respect to the original plane of the grinding wheel, and to be locked into position in that plane.

If the angle is measured with respect to a vertical resting position of the grinding wheel, then the wheel may suitably be located at any angle, for instance up to 120, with respect to such a position. Generally, it is found in practice that an angle up to 90 with respect to the vertical is sufficient to provide all the necessary grinding planes.

The alignment mechanism enables the grinding wheel to be moved in a fixed plane with respect to the plane of the wheel and, once more, to be locked in the desired position. This plane is suitably at right angles to the axis of the wheel.

According to another aspect of the present invention, there is provided a grinding device comprising a support framework, a grinding wheel coupled to an electric motor, a tool support platform, and adjustment means; the construction and arrangement being such that the grinding wheel can be orientated in space and moved to a position relative to the tool support platform by means of the adjustment means, and locked in that position.

The adjustment means is suitably the same as that described above in connection with the broadest aspect of the invention.

The tool support platform is preferably relocatable with respect to the grinding wheel and is removable from the framework. This permits attachment of a variety of different tool support platforms depending upon the type of tool being operated upon. Thus, for instance, a different support platform would be employed for sharpening a chain saw than is employed for sharpening a drill bit or a pair of scissors.

Preferred embodiments of the invention will now be described with reference to the accompanying drawings, in which:

FIG. 10 is a perspective view of a planar blade support platform for attachment to the grinding device of the present invention;

FIG. 11 is a perspective view of a chain-saw blade support platform for attachment to the grinding device of the present invention;

FIG. 12 is a perspective view of a twist drill-bit support platform for attachment to the grinding device of the present invention; and FIG. 13 is a perspective view of a chain-saw bar dressing and regrooving jig for attachment to the grinding device of the present invention.

Figure 1:
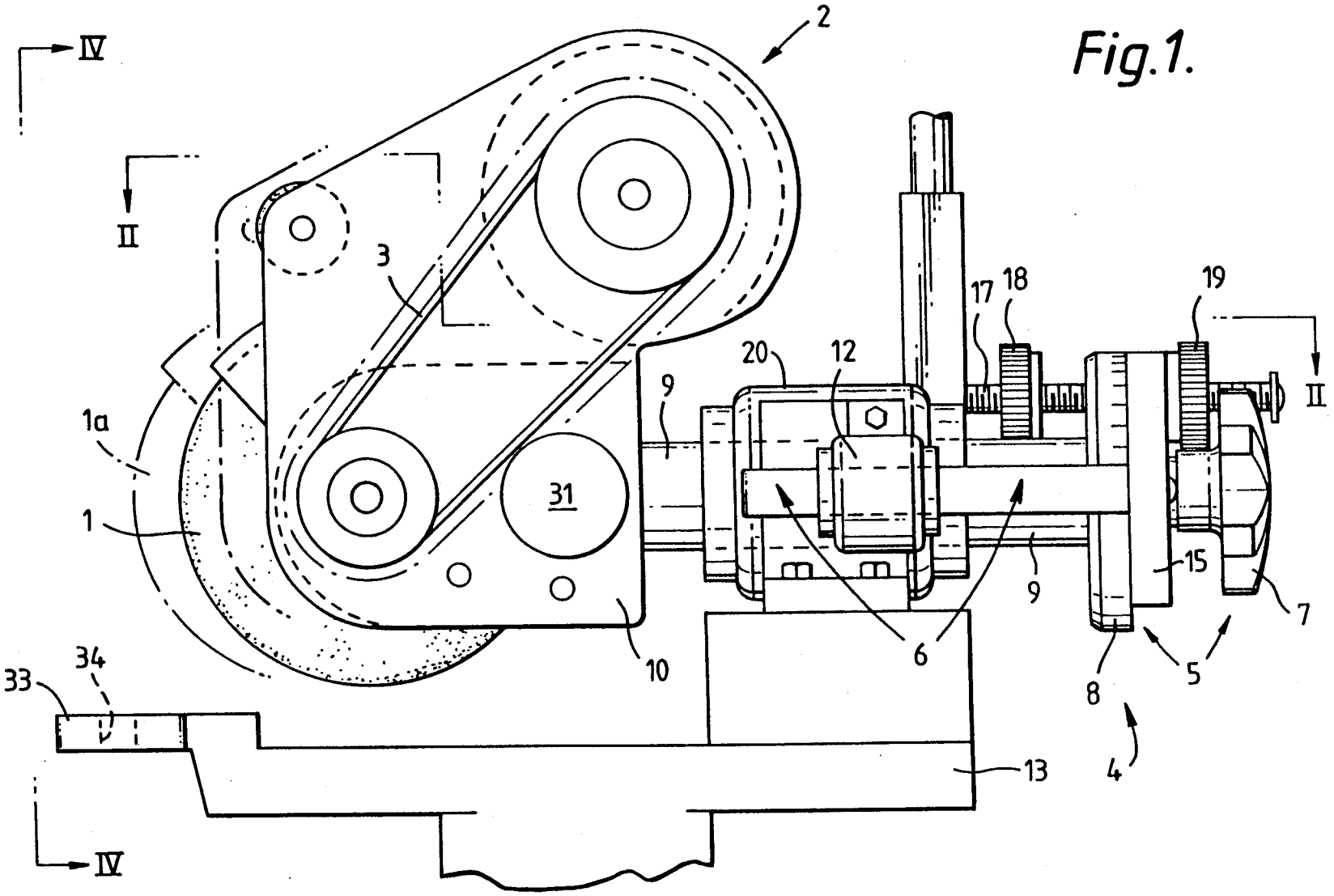
FIG. 1 is a rear side view of a grinding device according to the present invention, depicting a tilting and wheel alignment mechanism.
Figure 2:
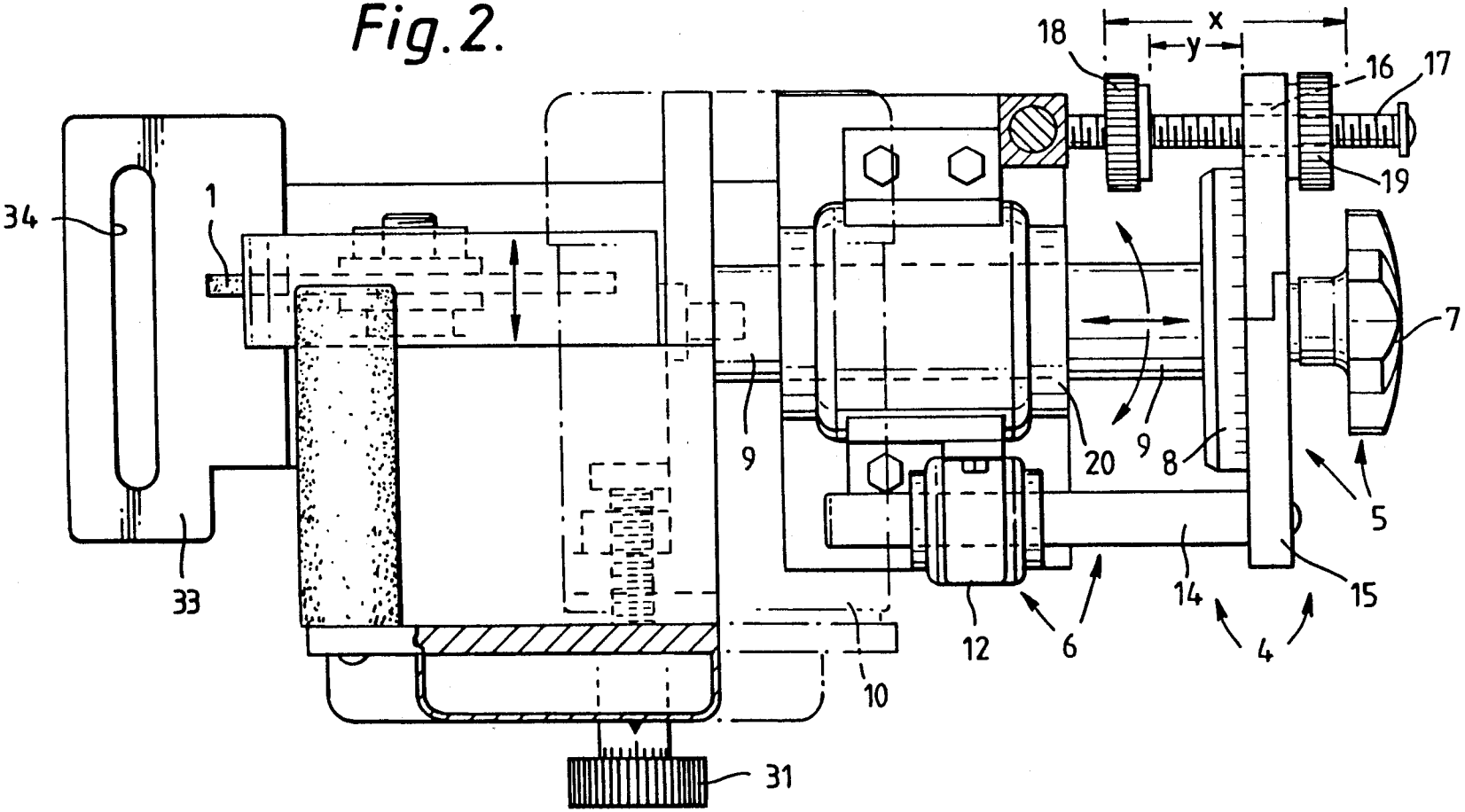
FIG. 2 is a plan view of the device as seen through II—II of FIG. 1.

Referring to FIGS. 1 through 5, the grinding device includes a grinding wheel 1 in the form of an abrasive disc of known type which is selected according to the particular object to be sharpened. The wheel 1 is driven by a belt drive 3 connected to an electric motor 2. The grinding wheel and electric motor are supported atop a suitable framework 13.

A grinding wheel adjustment means is depicted generally at 4. This comprises a tilting mechanism 5 and a wheel alignment mechanism 6. The tilting mechanism 5 includes a locking knob 7, a calibrated disc 8, and a support shaft 9 which is rigidly connected to a housing 10 supporting the grinding wheel 1 and the electric motor 2. Manipulation of the locking knob 7 by rotation to an unlocked position permits the shaft 9 with attached grinding wheel 1 to be rotated to any one of an infinite of planes lying at an angle with respect to the vertical. The angle is marked on the calibrated disc 8 and is suitably in the range of +90°to −45°.

Figure 3:
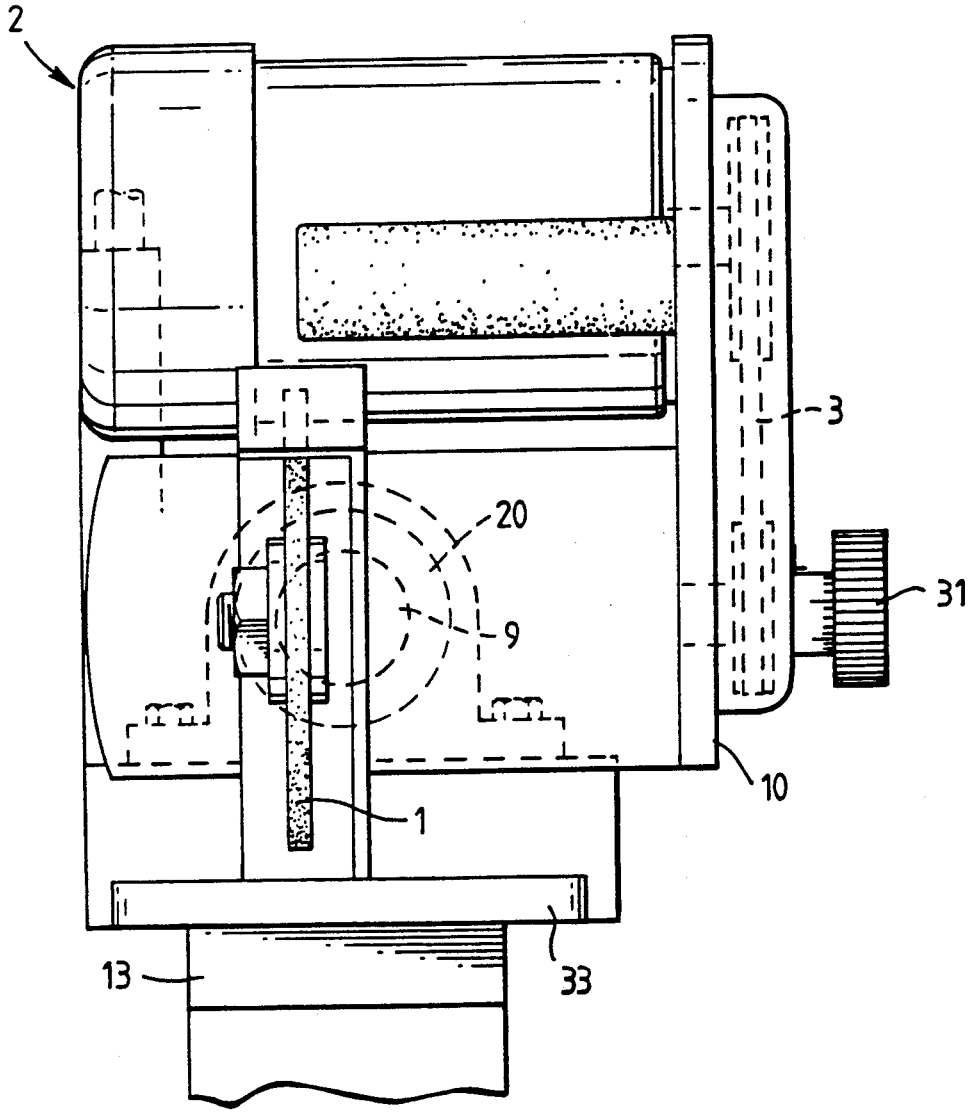
FIG. 3 is an end view of the device of FIG. 1 with the grinding wheel arranged in a vertical plane.
Figure 4:
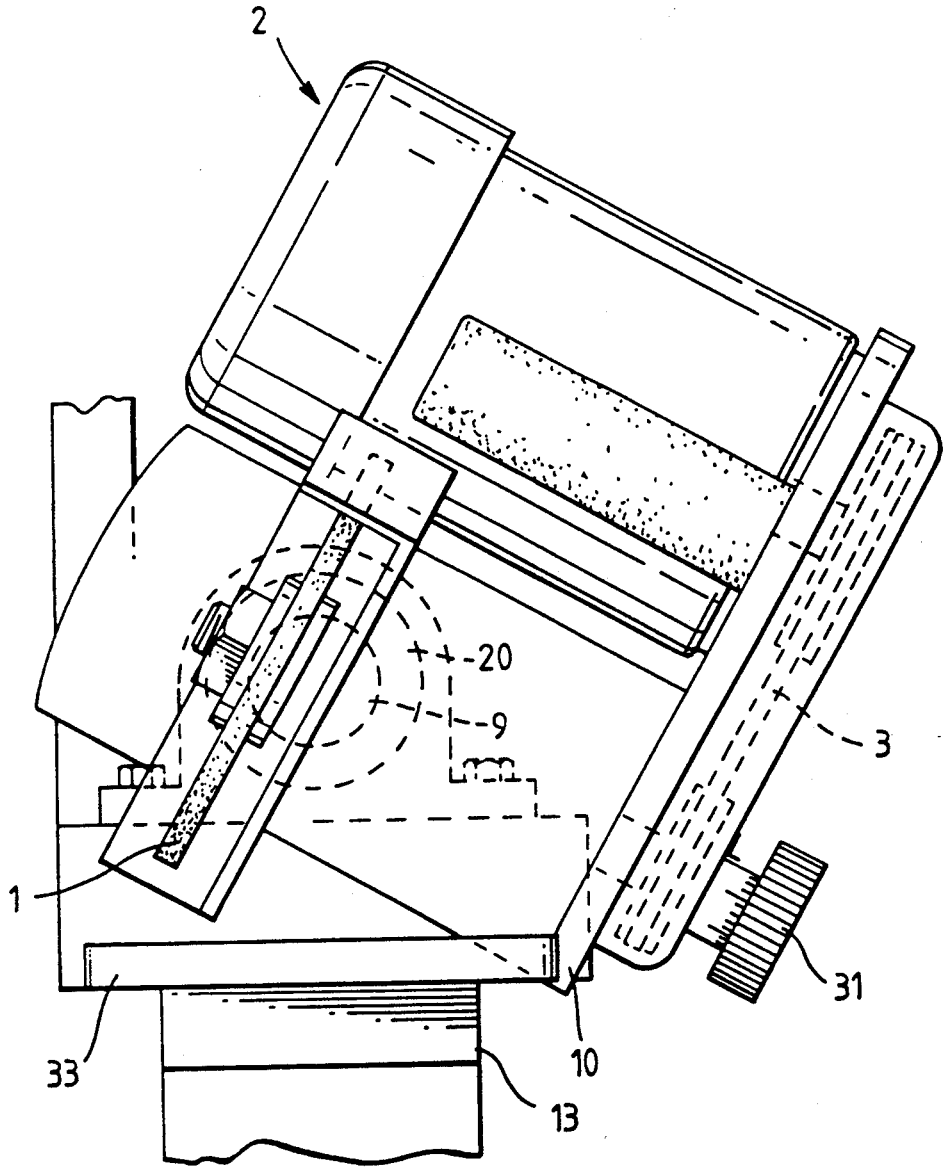
FIG. 4 is an end view of the device of FIG. 1 with the grinding wheel inclined at an angle with respect to the vertical.

FIG. 3 depicts the grinding wheel arranged in a vertical position whilst FIG. 4 depicts the blade at an angle of about −45°. The grinding wheel 1 may be locked in the its desired orientation by tightening the locking knob 7.

The grinding wheel alignment mechanism 6 includes a housing 12 fixed to the framework 13 which supports the grinding wheel and electric motor. The housing 12 accommodates a shaft 14 movable in the same axial direction as the support shaft 9. This shaft 14 is integrally connected to a base plate 15. The base plate 15 includes an opening 16 through which a threaded member 17 extends. Knurled threaded wheels 18, 19 are located on the threaded member 17 on opposite sides of the base plate 15. The threaded member 17 is rigidly connected to a housing 20 at one end, which forms part of the framework 13, and extends parallel to the shaft 14. The arrangement permits the movement of the grinding disc 1 to the position 1*a*, as depicted in FIG. 1, by appropriate rotational manipulation of the threaded wheels 18, 19 and the manual displacement of the base plate 15 in the direction of the axis of the support shaft 9. That is, manual displacement of the base plate 15 results in the shaft 14 being displaced relative to the housing 12, and the framework 13. Similarly, the support shaft 9 is displaced relative to its housing 20 and the framework 13. The amount of displacement is governed by the position of the threaded wheels 18, 19 on the threaded member 17 and the distance "y" (see FIG. 2). When the grinding wheel has been located at its required work location, the threaded wheels 18, 19 are then locked tightly against the base plate 15.

Figure 5:
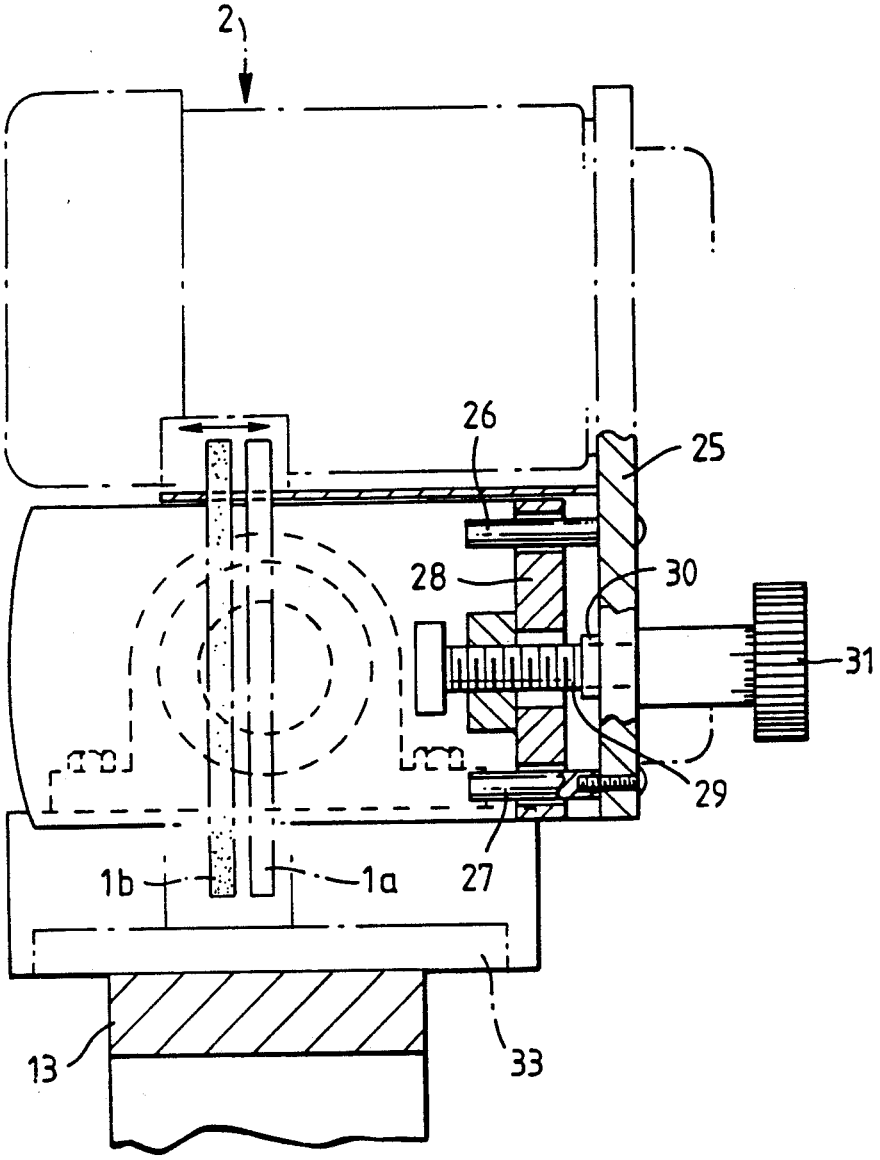
FIG. 5 is a view of the device as seen through IV—IV of FIG. 1 depicting a grinding wheel displacement mechanism.

Further adjustment of the grinding wheel 1 may be effected by the wheel displacement mechanism depicted in FIG. 5. This includes a fixed base plate 25 from which support pins 26, 27 extend. These support pins pass through machined openings in a base frame 28 which carries the grinding wheel 1. A displacement mechanism comprising a threaded shank 29 secured to the base frame 28, and a mating internally threaded member 30 fixed to the base plate 25, permits the grinding wheel 1 to be moved to position 1*b* by rotation of a knob 31 which co-acts with the threaded member 30. That is, rotation of the knob 31 results in the threaded shank 29 being drawn into or out of the threaded member 30 with the resultant displacement of the grinding wheel.

Turning now to FIGS. 6—13 of the drawings, there are depicted various tool support platforms. These are adapted to be attached to the framework 13 of the grinding device on table 33. The table 33 is a flat platform with an opening 34 for accommodating either a threaded projection 35 on the tool support platform, or a separate bolt, and locking nut.

Figure 6:
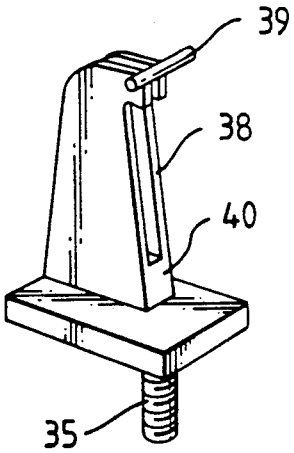
FIG. 6 is a perspective view of a flat blade support platform for attachment to the grinding device of the present invention.

The flat blade support platform depicted in FIG. 6 comprises an upwardly extending grooved member 38 with a short rod 39 projecting transversely across the top thereof. In use, the grinding wheel is located inside the grooved member so as to project a finite distance through the sloping face 40. A blade of a knife, chisel or other like flat-bladed implement to be sharpened is then rested against the sloping face 40 and moved upwardly against the rotating grinding disc and then moved horizontally to produce a uniform cutting edge hones to the desired degree of sharpness.

The rod 39 is provided for the purpose of sharpening scissors and like objects. In such a situation, the grinding disc is positioned outside the grooved member 38 at a pre-determined angle with respect to it. A blade of the scissors is then rested on the rod 39 and moved at substantially right angles with respect thereto, against the rotating grinding disc to, once again, produce a uniformly honed blade.

Figure 7:
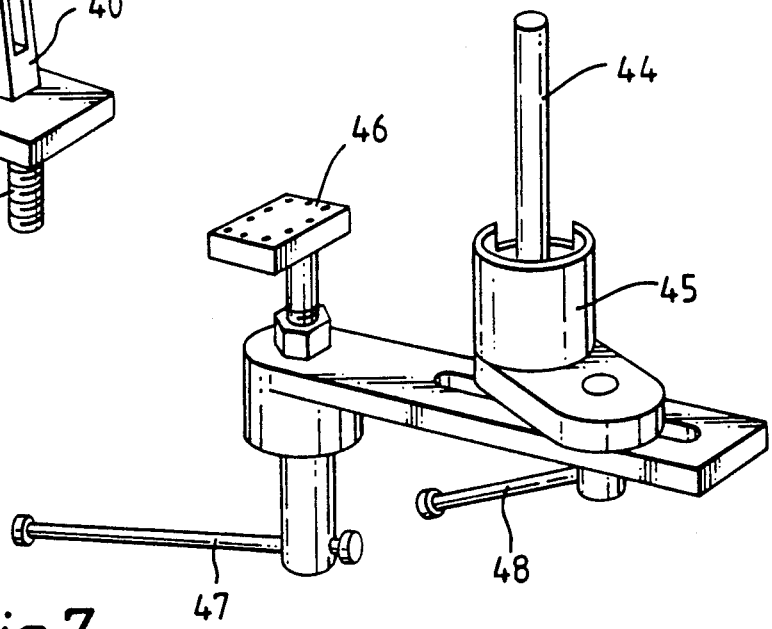
FIG. 7 is a perspective view of a circular saw blade support platform for attachment to the grinding device of the present invention.

The circular saw blade support depicted in FIG. 7 comprises a blade alignment shaft 44, fixed to an eccentrically positionable housing 45. A pad 46 is also provided. In use, the circular saw blade is clamped onto the shaft 44 by means of a centering cone (see FIG. 9) with the outer rim of the blade resting on pad 46. The grinding disc is then set at the desired position and inclination and the entire support is manipulated by levers 47, 48 to bring the blade into position for the grinding disc. By continual to and fro movement of the support 25, each tooth of the blade can be honed accurately to the required degree of sharpness.

Figure 8:
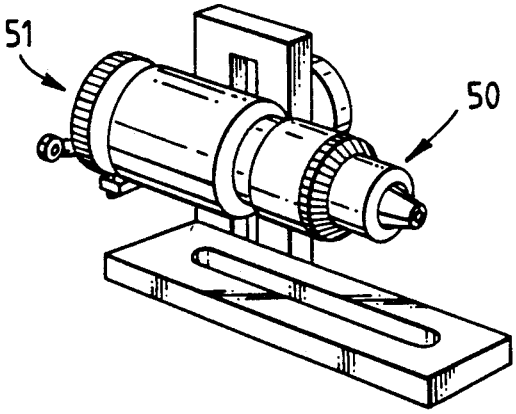
FIG. 8 is a perspective view of an adjustable chuck for attachment to the grinding device of the present invention.

The chuck depicted in FIG. 8 is specifically adapted to retain tools and other metal implements having a spindle as part of their construction; that is, implements such as saw hole cutters and valves. The chuck comprises a retaining means, indicated generally at 50, and a ratchet mechanism, indicated generally at 51. The ratchet mechanism is such as to permit rotation of the retaining means by pre-determined and specific amounts, as well as to permit the axial location of the retaining means. In use, the implement to be ground or sharpened is secured by the retaining means 50. The grinding disc 1 is then positioned at the desired position relative to the implement. The ratchet mechanism is actuated to bring the implement into contact with the grinding disc and grinding is commenced. After a predetermined interval of time, when grinding of a section of the implement has been completed, the ratchet mechanism is manipulated to rotate the implement to a second position for grinding. The process is continued until all faces of the implement have been ground to the desired degree.

Figure 9:
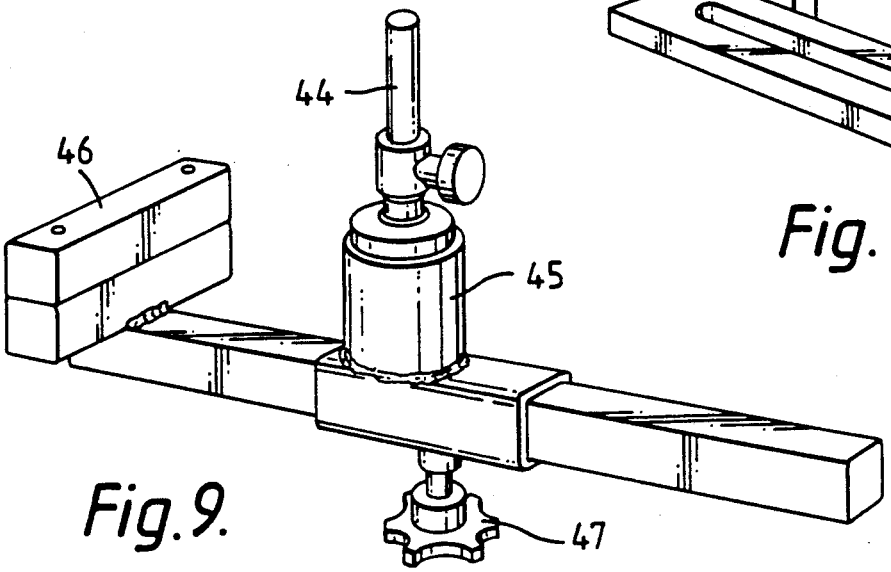
FIG. 9 is a perspective view of a further circular saw blade support platform for the setting of blades and used in conjunction with the platform of FIG. 7.

FIG. 9 depicts a further embodiment of the circular saw platform depicted in FIG. 7 and like numerals indicate like parts. The blade is secured as in FIG. 7 and the teeth are set in turn, over anvil 46 by means of a hammer.

The planar blade support shown in FIG. 10 comprises a flat metal surface 60 with a backing plate 61. The planar blade may be sharpened by securing the blade between the flat metal surface 60 and backing plate 61 with retaining screws 62; or directly to the fact of the surface 60. Alternatively, the support may simply provide a surface on which the blade is rested while being ground.

FIG. 11 depicts a chain saw blade support platform. This comprises a shank 70 along which a tensioning member 71 is adapted to slide. The tensioning member 71 includes a slotted disc 73 on its uppermost surface, and a locking screw 74 to lock the tensioning member at a desired position on the shank 70. The shank 70, is rigidly connected to a base station 76 which includes a slotted twin plate 72.

In use, a chain saw blade is positioned so as to extend around the slotted twin plate 72 and the slotted disc 73, with the inwardly facing blade sections of the chain saw blade projecting into the slotted portions of the twin plate 72 and slotted disc 73. The tensioning member 71 is then moved along the shaft in the direction of the arrow to take up the slack in the chain, and it is held in that position with the locking screw 74. The slotted twin plate 72 with chain saw blade is then located at the desired cutting position with respect to the previously positioned grinding disc and grinding is commenced. Each tooth of the chain is ground in turn by rotation of the chain about the slotted disc 73.

The twist drill support platform shown in FIG. 12 comprises a longitudinally grooved casing 80 which is adapted to locate a twist drill in a generally horizontal disposition. A locking mechanism 81 retains the twist drill in a fixed position and permits rotation thereof, whilst an adjustment means 82 permits rotation of the grooved element in a horizontal plane.

In use, the grinding disc is arranged at an inclined angle at a predetermined position with respect to the twist drill support platform. A twist drill is secured in the grooved casing 80 and moved against the grinding wheel. Simultaneously, the locking mechanism 81 is manipulated to rotate the twist drill, thereby permitting a uniform grinding down of the end of the twist drill to the desired degree of sharpness.

The chain saw bar dressing and re-grooving jig depicted in FIG. 13 comprises a flat base plate 90 on which the face of a chain saw bar is adapted to rest; a guide fence 91 against which the edge of the chain saw bar is urged; a recess 92 formed between the guide fence, base plate and support 93; and a mounting hole 94. A mounting screw 95 is contained in a recess leading to the mounting hole.

In use, the grinding disc is arranged at right angles to its support base so that it projects through the recess 92 by a small distance. The flat face of a chain saw bar is then laid on the base plate 90 an its edge is manually urged against the rotating grinding disc as it is moved in the direction of the arrow. The same process is repeated for the opposite edge of the chain saw bar by inverting the bar, and the end sections of the bar are ground by moving the saw blade in an appropriate arc.

The purpose of the mounting hole 94 is to permit a diamond dresser to be located therein. The diamond dresser comprises a round bar with a diamond cutting head. When the diamond dresser is secured in the mounting hole 94 by means of the mounting screw 95, it enables the grinding disc to be dressed.

The jig may also be used to regroove a chain-saw bar by the use of a very thin grinding disc. Suitable discs are in the order of 1.6 mm in thickness.

From the above, it will be clear that the present grinding device is adaptable to grinding a wide range of implements ranging in size from the very small to the very large, and that such grinding can be achieved within quite defined and reproducible limits. It will further be appreciated that the invention is not limited to the specific embodiments described above but may taken on substantial modifications without diverging from the basic inventive concept.

The claims defining the invention are as follows:

1. A grinding device, comprising:

a framework;

a grinding wheel supported by said framework;

an electric motor operatively connected to said grinding wheel, said grinding wheel and said electric motor provided within a first housing;

a second housing rigidly connected to said framework;

a manually operated tilting mechanism for moving an locking said grinding wheel to any one of an infinite number of planes, lying at an angle with respect to the original plane of said grinding wheel, said tilting mechanism provided with a means for locking said grinding wheel into place, said tilting mechanism further provided with a first shaft rigidly connected to said first housing, said first shaft extending through said second housing; and a first manually adjustable grinding wheel alignment mechanism operatively connected to said grinding wheel to horizontally displace said grinding wheel within the same plane of an original position of said grinding wheel, and to lock said grinding wheel in a desired position, said first alignment mechanism provided with a second shaft rigidly connected to said second housing, a third housing rigidly connected to said framework and a third shaft operatively connected to said second shaft and rigidly connected to said third housing, said first shaft, said second shaft and said third shaft parallel with one another.

2. The grinding device in according with claim 1, further including a tool support platform supported by said framework, wherein said grinding wheel can be oriented in space and moved to a position relative to said tool support platform, and said manually operated tilting mechanism.

3. The grinding device in accordance with claim 1, further including a second manually adjustable grinding wheel alignment mechanism rigidly connected to said first housing for moving, and locking said grinding wheel to a position in a plane parallel to the plane of the original position of said grinding wheel, said first manually adjustable grinding wheel alignment mechanism capable of locking said grinding wheel into proper position.

4. The grinding device in accordance with claim 1, further including a means for measuring the angle of said grinding wheel with respect to the original plane of said grinding wheel allowing said tilting mechanism to be properly locked in place.

5. The grinding device in accordance with claim 1 wherein said grinding wheel is driven by a belt drive.

6. The grinding device as claimed in claim 2 wherein said tool support platform is relocatable with respect to said grinding wheel and is removable from said framework.

7. The grinding device as claimed in claim 2, wherein said tool support platform includes one of the following attachments: a flat blade support, a circular saw blade support, an adjustable chuck, a planar blade support, a chain saw blade support or a twist drill-bit support.

* * * * *